United States Patent [19]

Ford et al.

[11] Patent Number: 4,884,816

[45] Date of Patent: Dec. 5, 1989

[54] THESAURUS GAME APPARATUS

[76] Inventors: Kenneth R. Ford; Ellen L. Ford, both of 6260 - 16th St., S., St. Petersburg, Fla. 33705; Edward Nygren; Joyce Nygren, both of 866 Placido Way, N., St. Petersburg, Fla. 33704

[21] Appl. No.: 172,211

[22] Filed: Mar. 23, 1988

[51] Int. Cl.[4] ..... A63F 3/00

[52] U.S. Cl. ..... 273/240; 273/272; 273/144 R

[58] Field of Search ..... 273/240, 249, 243, 246, 273/272, 144 A, 144 B, 144 R

[56] References Cited

U.S. PATENT DOCUMENTS

| | | | |
|---|---|---|---|
| 1,211,103 | 1/1917 | Devlin | 273/240 |
| 2,212,846 | 8/1940 | Pilla | 273/243 |
| 2,539,216 | 1/1951 | Weinschenk | 273/144 A |
| 2,615,718 | 10/1952 | Robbins | 273/144 A |
| 4,216,594 | 8/1980 | Farley et al. | 273/249 |
| 4,666,161 | 5/1987 | Elesie et al. | 273/246 |
| 4,682,777 | 7/1987 | Wood | 273/243 |

FOREIGN PATENT DOCUMENTS

| | | | |
|---|---|---|---|
| 2187393 | 9/1987 | United Kingdom | 273/249 |

*Primary Examiner*—Edward M. Coven
*Assistant Examiner*—Benjamin Layno
*Attorney, Agent, or Firm*—Richard C. Litman

[57] ABSTRACT

An educational device employing a game to teach words and their meanings. This educational device is comprised of four groups of game cards and a playing board. The front face of each game card is divided into six word designations and on the back of the card are the meanings of that word designation. The playing board is divided into four stations of play, each equipped with an erasable answer slate for writing each player's answers and score board. The game board has two scoring disc holders and a spin dial and pointer used to randomly select a game card from a particular group of cards and to randomly select a word on the game card. The spin dial is divided into twenty-four sectors, each of which is color coded to correspond to one of the four color coded groups of cards. Each color coded sector has an indicia corresponding to one of the six word designations on one of the four playing card groups. For quick reference the twenty-four sectors and the corresponding playing cards are color coordinated.

9 Claims, 4 Drawing Sheets

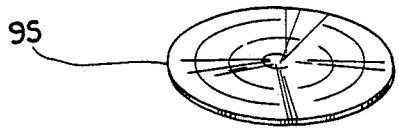
FIG. 4
FIG. 5
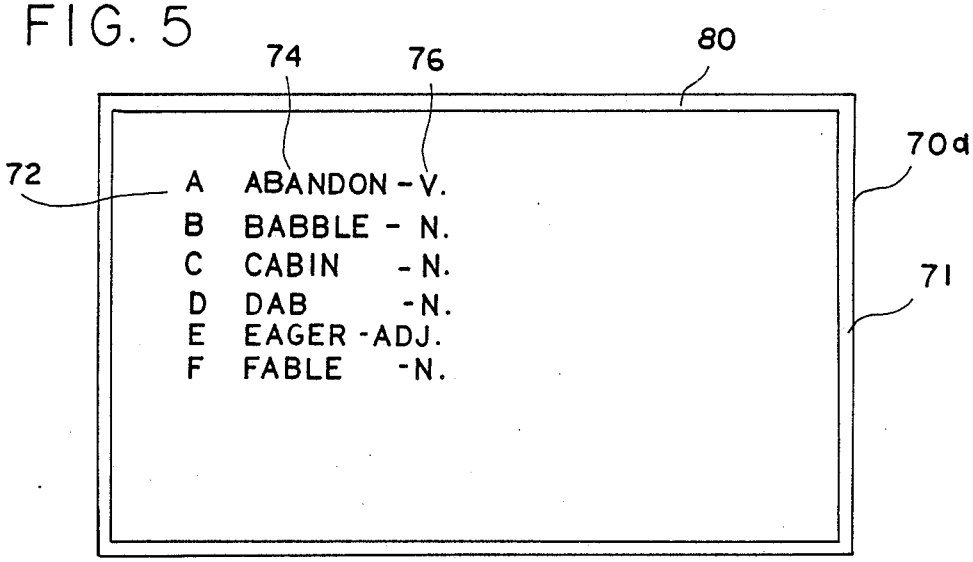
FIG. 6
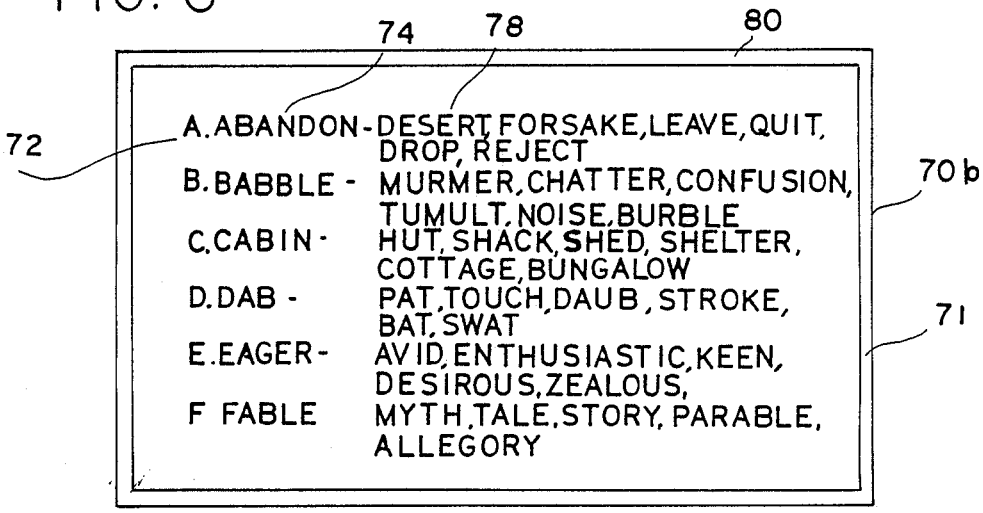

THESAURUS GAME APPARATUS

BACKGROUND OF THE INVENTION

The present invention relates to a game that combines education and entertainment in a complementary manner so that players of the game learn definitions, synonyms, or foreign language equivalents, while competing in a challenging way.

Although the number of words in the English language has increased over the past several centuries, the vocabulary of the common citizen remains limited. Often, the same words are used over and over again in both conversation and in writing. School teachers warn their students about this, but few actually develop "word power." To bolster this effort, various educational techniques are used, including reliance upon a thesaurus. But none of these approaches provide an entertainment quality that turns the teaching of words and their meanings into fun.

The prior attempts at providing a vocabulary game of entertainment and educational value have employed similar components, such as cards and a spin dial. Most notably is the 1981 patent, U.S. Pat. No. 4,306,725, issued to Sawyer for a "Thesaurus Card Game." This game includes playing cards of substantially different construction and the relation between the random selection apparatus of this invention and the cards is clearly distinguishable from the present invention. Accordingly, this patent, as well as other various prior art word game apparatuses are not deemed, either singly or in combination, to teach the present invention as described in the claims appended thereto.

The thesaurus game of the invention utilizes a plurality of game cards, a device for the random selection of play, means for recording answers, and means to keep score.

In accordance with the present invention, there is provided four groups of game cards. One group contains words beginning with the letters "A" through "F." A second group has words beginning with the letters "G" through "N." The third group has words beginning with the letters "O" through "Z." The fourth group of cards contains words considered more difficult than the words on the other cards, being designated as "Double Risk" and "Triple Risk" words. Each group of cards is color coordinated to corresponding indicia of the random selecting device of the invention.

On the front of each game card are various alphabetical or risk element designations along with a corresponding word and its part of speech. On the back of each card are acceptable definitions which correspond to the subject word.

In the preferred embodiment, a spinning pointer, situated in the middle of the rigid, generally flat board is used to randomly select a designation for play which corresponds to one of the four card groups. This destination includes the appropriate line of play on the card group selected along with color coding for quick reference.

The spinning pointer is pivotably mounted in the center of the board so that the indicator can be spun around the circular dial face of the device. The dial face is divided into twenty-four equal sections, each corresponding to the alphabetical and risk element designations contained on the face of the game cards having the same color designation. When spun, the head of the spinning pointer comes to rest in one of the twenty-four sections.

In the alternate embodiment, a dispensing device can be used as a random selection device. Twenty-four spherical elements are color coded and have indicia thereon of the same nature as that contained on the dial face of the preferred embodiment. A board having the other components of the game apparatus can be used with this embodiment, or, the other components can be separately constructed for use in playing the game.

If employed, the game board has four stations of play, one for each of the participants. Each play station consists of an erasable answer slate and a scoring table. The board also has two scoring disc holders which hold the discs to keep score on the scoring table.

These and other features of the game apparatus are more fully described herein.

SUMMARY OF THE INVENTION

It is an object, advantage and feature of the invention to provide an educational and entertaining game apparatus for the teaching of words and their meanings.

It is a further object, advantage and feature of the invention to provide a novel construction for random selection devices.

It is a further object, advantage and feature of the invention to provide a novel construction of game cards.

It is still a further object, advantage and feature of the invention to provide a novel relationship between the random selection device and the game cards.

Other and further objects of the present invention will become apparent from the following description.

BRIEF DESCRIPTION OF THE DRAWINGS

FIG. 4 is a perspective view of the scoring disc of the invention.

FIG. 5 is a front face view of a representative card of one of the cards in the group having words thereon beginning with the letter "A" through "F;" said card having similar features of cards in the groups having words beginning with the letter "G" through "N," and "O" through "Z."

FIG. 6 is a rear face view of the card illustrated in FIG. 5.

These figures illustrate the invention; the components thereof are numbered so that like components are assigned like numbers throughout, as discussed in the following description.

DETAILED DESCRIPTION OF THE PREFERRED EMBODIMENT

Figure 1:
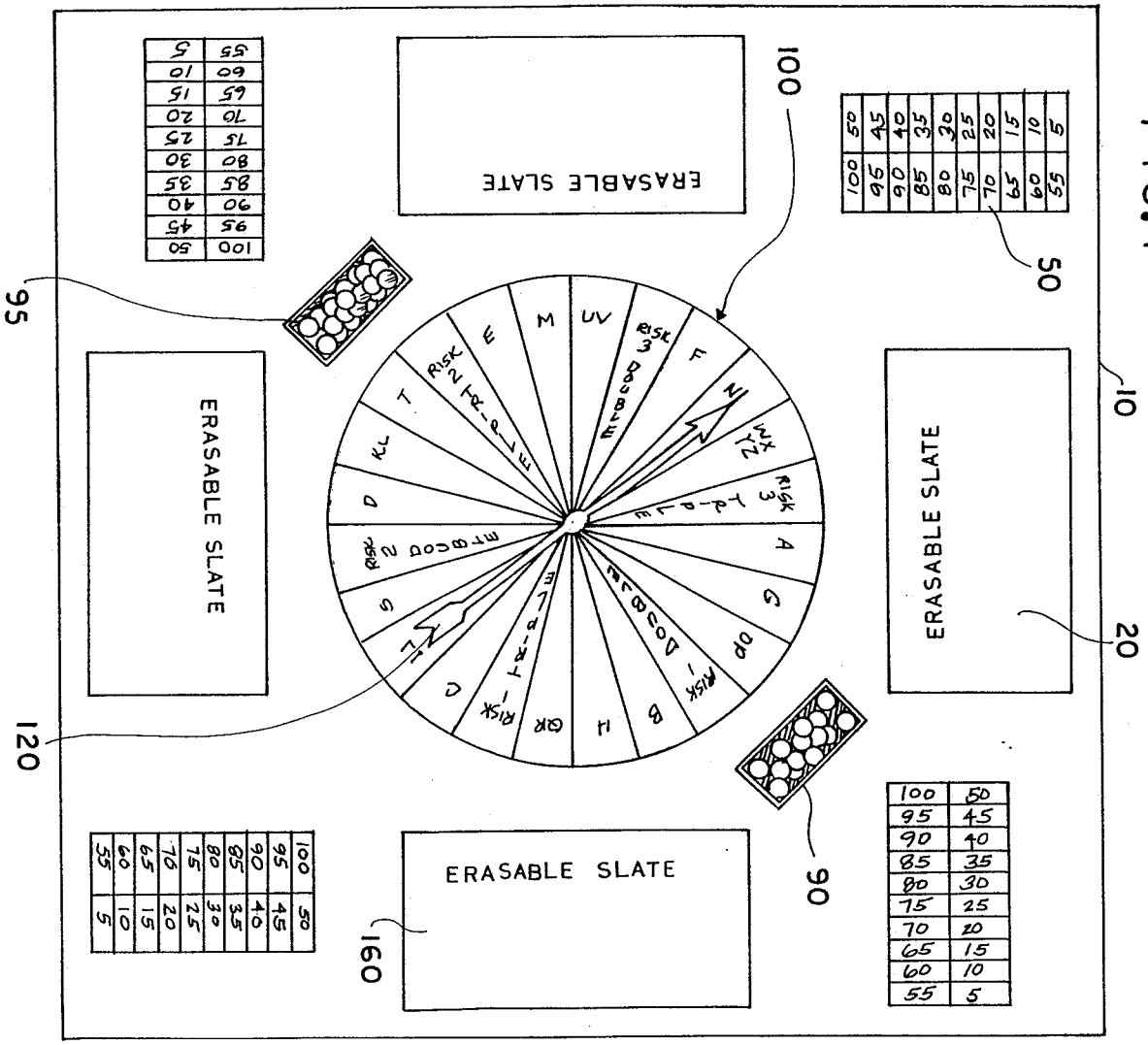
FIG. 1 is a top plan view of the game board of the preferred embodiment of the invention.
Figure 2:
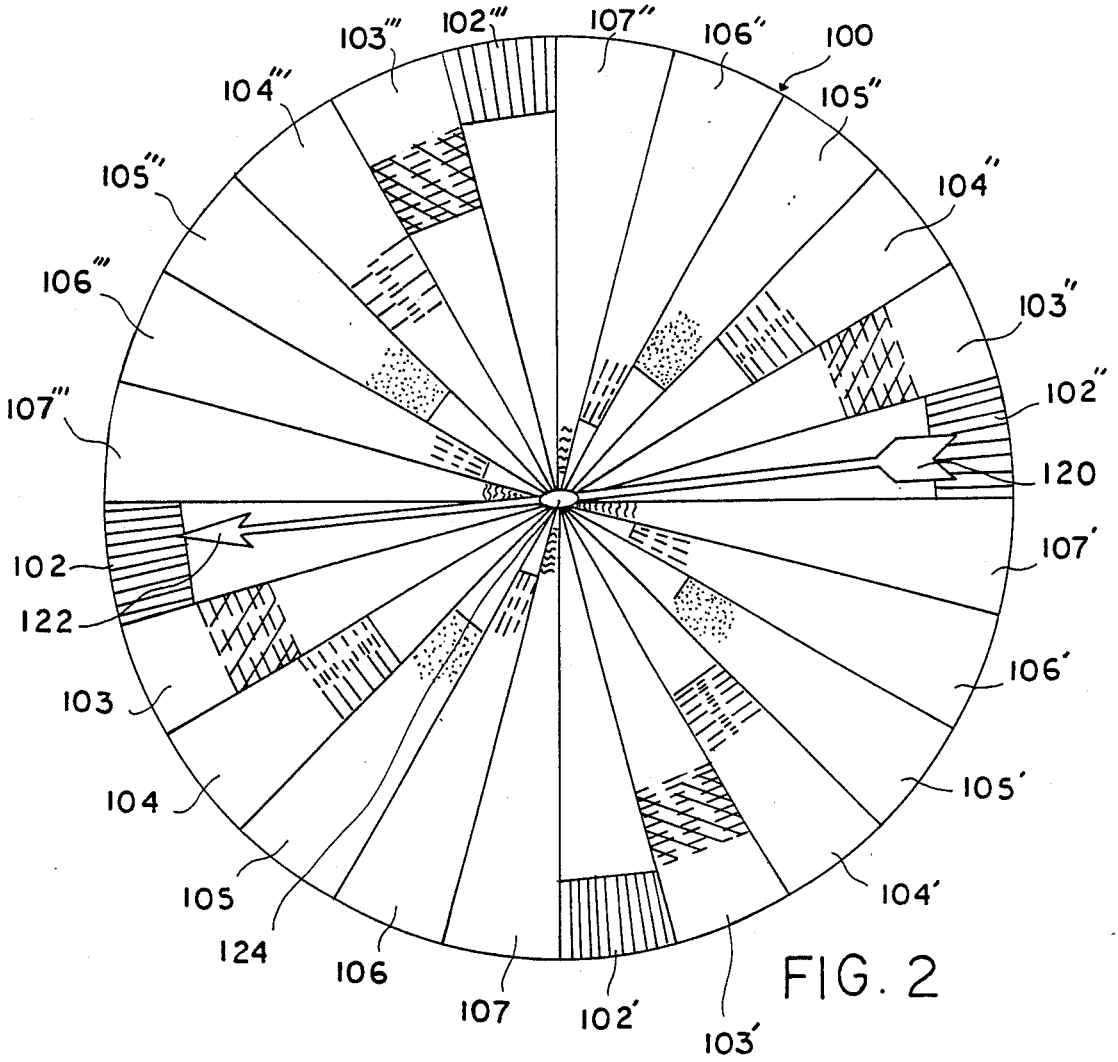
FIG. 2 is an enlarged view of the spinning device and circular dial face of the random selection component of the preferred embodiment of the invention.

The method of play and apparatus used in the present invention is best described by reference to a specific detailed embodiment. Nevertheless, it is to be understood that the drawing and description are not limiting upon the scope of the present invention since various apparatus can be utilized in the determination of game card selection. Any means for randomly selecting numbers can be substituted, as well as the particular spinning apparatus as shown in FIGS. 1 and 2. Similarly, any scorekeeping apparatus with a means to add and subtract points towards a total can be employed. The construction of the scorekeeping means shown in FIG. 1 is especially advantageous for use in connection with play of the present invention, as will be discussed in further detail hereinafter.

Referring first to FIG. 1, there is shown a top plan view of the game board 10 of the present invention, comprising of a spinning indicator 120 supported over a circular dial face 100, separated into twenty-four equal (color coded) segments 102–107, 102′–107′, 102″–107″, and 102‴–107‴ (as shown enlarged in FIG. 2), a plurality of erasable answer slates 160, scoring boards 50, scoring disc holders 90 and scoring discs 95. Each of the twenty-four equal segments 102, et seq. include an imprinted alphabetical or risk element indicia. The dial face 100 is also imprinted on the game board 10 and is used as a base to support a pivot stem (not shown), which pivotally supports the spinning indicator 120. Although the dial face is divided into twenty-four segments 102, et seq. of equal size, it is within the scope of the present invention to vary the size of the segments if desired. However, equal size of each segment as shown allows an equal chance for indicia to be selected. Continuing with FIG. 1, the score boards 50, of which there are four, are rectangular in nature and divided into twenty equal blocks each with imprinted sequential integers from 5 through 100. The features of the scoring board 50 and scoring discs 95 and holder 90 will be expanded on further in greater detail hereinafter by way of example through discussion of game play.

FIG. 2 which shows an enlarged view of the random selecting device of the preferred embodiment which is in the form of a spinning indicator and dial face. The dial face 100 as previously described is divided into twenty-four equal sections 102, et seq. which are color coordinated and correspond to the particular alphabetical or risk element indicia on each game card. The dial face 100 has its twenty-four sections color coded into four groups, six sections within each group. Each section within the group have the same color and correspond with like grouping on the game cards. For example, sections 102, 103′, 104″, 105‴, 106, 107″ can correspond with the cards having words thereon, beginning with the letter "A" through "F," and the other sections correspond with the other three groups of cards. The color coding allows for quick reference to this particular indicia by color as opposed to looking for the actual word which corresponds to that indicia selected, which in turn speeds up game play by avoiding unnecessary time spent looking for the appropriate word.

Figure 3:
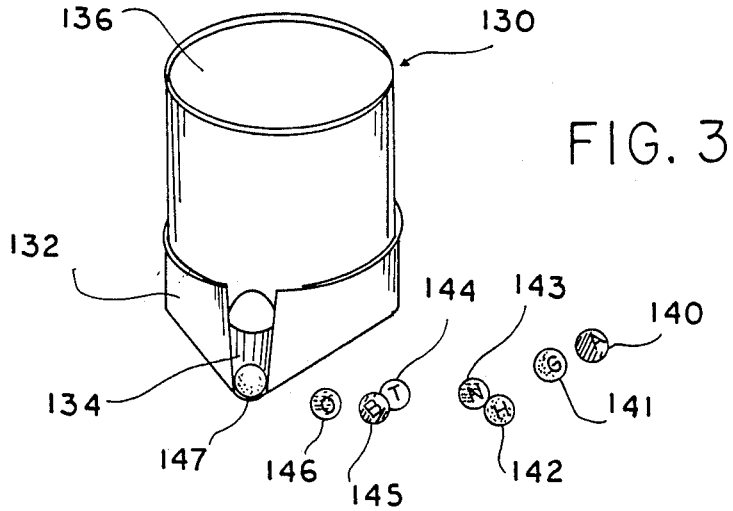
FIG. 3 is a perspective view of the dispensing device and spherical elements comprising the random selection component of an alternate embodiment of the invention.

Referring now to FIG. 3, there is shown an alternate embodiment of the random selection device, comprising receptacle 130 having a cavity 136 therein. At the base of said receptacle is an opaque collar 132 which shields said base from view and forms a channel for color coded spherical elements 140, 142, 144, 146, and 147 (representative of the 24 spherical elements) to be dispensed singly through a dispensing valve 134.

FIG. 4 illustrates the disc 95 used in connection with disc holder 90 in order to keep score.

Figure 7:
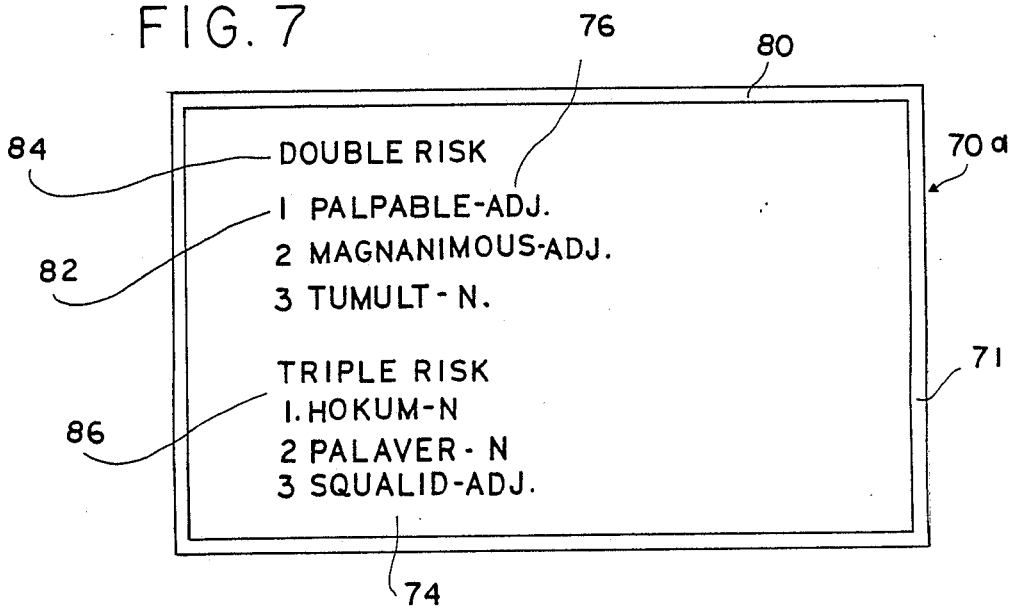
FIG. 7 is a front view of the group of cards having "Double Risk" and "Triple Risk" designations thereon.

Referring now to FIGS. 5 through 8, there is shown a front face of a representative of a plurality of game cards **70*a* (shown in FIGS. 5 and 7). The left side of the front face is separated into distinct categories, either alphabetical element 72 or risk element 82 each corresponding to segments of the dial face of the spinning indicator in FIG. 2. Each alphabetical or risk element indicia is color coded with the corresponding indicia of the dial face. Opposite the alphabetical column 72 or risk element column 82 is the game word 74 and its corresponding part of speech 76**.

Figure 8:
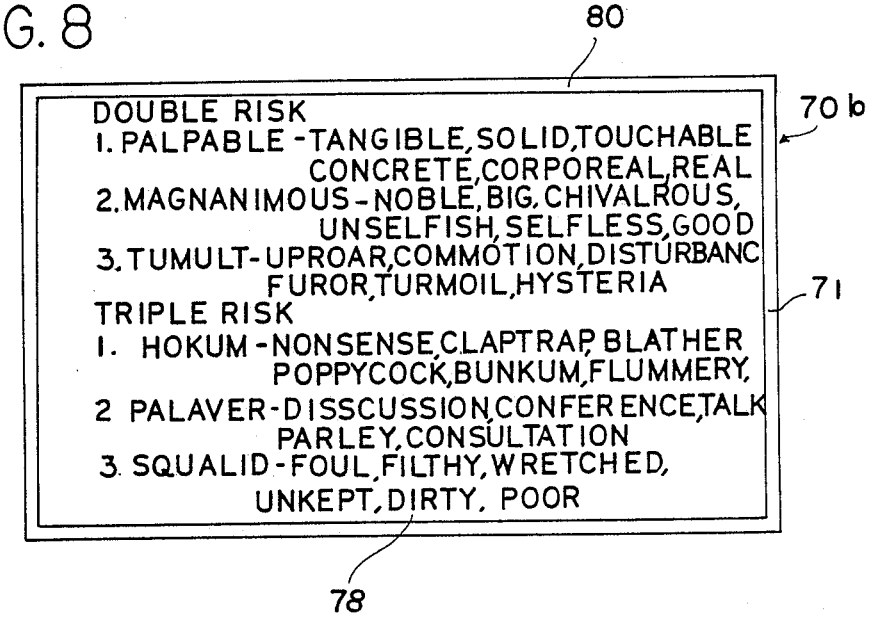
FIG. 8 is a rear face view of the card illustrated in FIG. 7.

Continuing with FIGS. 4 and 8 which show the reverse side **70*b* of the cards in FIGS. 5 and 7, respectively, are the same game words that appear on the front face 70*a* of that card. Opposite these words are a plurality of synonyms 78** which are considered correct answers.

Each card has a perimeter zone 71 which is color coded to like coding of the random selection means.

The game may be played by two or more individuals or teams, in the embodiment of the present invention up to four individuals or teams may play.

The game begins by one player or team spinning the pointer 120 which comes to rest above the alphabetical or risk element indicia on said equal segments. This corresponds to the specific indicia on the game card, which is the subject of play. The player then reads the word 74 and part of speech 76 which corresponds to the indicia selected and the players then have sixty seconds to write down on the erasable scoring board 160 a synonym which they feel will be matched on the reverse side of the game card **70*b*. Each player that matches a synonym is awarded one scoring disc 95. No discs are lost if an incorrect answer is given. Each scoring disc is worth 5 points and would be placed in the appropriate column of the scoring board 50. If the spinning indicator 120 lands on either a double risk 84 or triple risk 86 designation, the method of play is the same. Scoring, however, is different. The double 84 and triple 86 risk designations give the player the option of wagering two or three scoring discs 95 respectively upon the outcome of the question. If a correct answer is given, then depending upon the designation, either two or three scoring discs 95 are awarded. In contrast to the mode of scoring used with the alphabetical segments, however, an incorrect answer in a risk element category subjects the player to the loss of either two or three discs depending upon the level of risk involved in the question. Alternatively, players are not required to risk their scoring discs 95 in this fashion, and at the player's option, double 84 and triple 86 risk elements can be scored in the same way the alphabetical segments are. That is, if a player answers the question correctly, he or she will gain one scoring disc 95, but if his or her answer is incorrect, the player will not lose a scoring disc 95. Players cannot bet more discs than they have, thus a player without discs or with only one disc cannot take advantage of the double or triple risk designations and may accordingly only bet one scoring disc 95**. Each disc is worth five points and the first player or team to accumulate 20 discs or 100 points is the winner.

While preferred embodiments have been shown and described, various modificiations and substitutions to various components may be made without departing from the scope and spirit of the present invention. It can be seen from the above that what has been disclosed herein can be used to teach virtually any subject area, although the preferred embodiment is primarily directed to the teaching of synonyms.

I claim:

1. An apparatus for playing a game to teach words, their meanings, and synonyms or equivalents thereof, comprising:

a plurality of game cards, said cards divided into four groups, each group of cards bearing a first indicia wherein said first indicia differs from group to group to visually distinguish each of said group of cards, each group of cards bearing second indicia further distinguishing the four groups, said second indicia dividing each card into six visually distinctive zones representing six selective subject categories wherein said second indicia defining each group of cards as having six selective subject categories and that the six selective subject categories of one group of cards is different from the six selective subject categories of any other group of cards, means for randomly selecting a game card comprising, a circular dial face;

said dial face having a plurality of sections each said section bearing a first indicia and a second indicia corresponding to a group of cards and a particular subject category in said group of cards;

a spinning pointer pivotally attached in the center of said dial face for randomly selecting a section;

a plurality of erasable answer slates;

a plurality of scoring boards;

a plurality of scoring disc holders;

a plurality of scoring discs.

2. The apparatus of claim 1, wherein said first indicia are different colors and said second indicia are different letters each representing a different subject category of words.

3. The apparatus of claim 1, wherein said scoring boards have twenty sections thereon, each said section for placement of said scoring disc, so that placement of scoring discs in each said section of the scoring board signifies that player as the winner of the game.

4. An apparatus for playing a game to teach words, their meanings, and synonyms or equivalents thereof, comprising:

a plurality of game cards, said cards divided into four groups, each group of cards bearing a first indicia wherein said first indicia differs from group to group to visually distinguish each of said group of cards, each group of cards bearing second indicia further distinguishing the four groups, said second indicia dividing each card into six visually distinctive zones representing six selective subject categories wherein said second indicia defining each group of cards as having six selective subject categories and that the six selective subject categories of one group of cards is different from the six selective subject categories of any other group of cards, means for randomly selecting a game card comprising, a plurality of elements each bearing a first indicia and a second indicia corresponding to a group of cards and a particular subject category in said group of cards, a receptacle for retaining said elements therein, means for individually dispensing said elements from said receptacle;

a plurality of erasable answer slates;

a plurality of scoring boards;

a plurality of scoring disc holders;

a plurality of scoring discs.

5. The apparatus of claim 4, wherein said elements are spherical.

6. The apparatus of claim 5, wherein said receptacle has a collar at the base thereof for obstructing the view of the base of the receptacle from the players.

7. The apparatus of claim 6, wherein said dispensing means comprises:

a channel in said collar defining a path for same spherical element;

a valve means at the terminal end of said path which releases a single spherical element as desired by a player.

8. The apparatus of claim 4, wherein said scoring boards have twenty sections thereon, each said section for placement of said scoring disc, so that placement of scoring discs in each said section of the scoring board signifies that player as the winner of the game.

9. The apparatus of claim 8, wherein said first indicia are different colors and said second indicia are different letters each representing a different subject category of words.

* * * * *